US007322498B2

(12) United States Patent
Frost

(10) Patent No.: US 7,322,498 B2
(45) Date of Patent: Jan. 29, 2008

(54) BABY CARRIER

(75) Inventor: Karin A. Frost, Haiku, HI (US)

(73) Assignee: The Ergo Baby Carrier, Inc., Haiku, HI (US)

( * ) Notice: Subject to any disclaimer, the term of this patent is extended or adjusted under 35 U.S.C. 154(b) by 643 days.

(21) Appl. No.: 10/937,193

(22) Filed: Sep. 9, 2004

(65) Prior Publication Data

US 2005/0051582 A1 Mar. 10, 2005

Related U.S. Application Data

(60) Provisional application No. 60/501,396, filed on Sep. 10, 2003.

(51) Int. Cl.
*A47D 13/02* (2006.01)
*A45F 3/04* (2006.01)

(52) U.S. Cl. ..... 224/160; 224/155

(58) Field of Classification Search ..... 224/160, 224/155, 159, 259, 627; 24/301, 302; 2/920
See application file for complete search history.

(56) References Cited

U.S. PATENT DOCUMENTS

| | | | | |
|---|---|---|---|---|
| 3,327,914 | A * | 6/1967 | Abram | 224/159 |
| 4,009,808 | A | 3/1977 | Sharp | |
| 4,234,229 | A | 11/1980 | Arnold | |
| 4,333,591 | A | 6/1982 | Case | |
| D266,800 | S | 11/1982 | Kula et al. | |
| 4,434,920 | A | 3/1984 | Moore | |
| D277,811 | S | 3/1985 | Moore | |
| 4,579,264 | A * | 4/1986 | Napolitano | 224/160 |
| 4,986,458 | A * | 1/1991 | Linday | 224/160 |
| D324,607 | S | 3/1992 | Nelson | |
| D334,253 | S | 3/1993 | Balzarini | |
| 5,224,637 | A * | 7/1993 | Colombo | 224/159 |
| 5,246,152 | A | 9/1993 | Dotseth | |
| D357,800 | S | 5/1995 | Roan et al. | |
| D370,996 | S | 6/1996 | Shimura et al. | |
| 5,570,823 | A | 11/1996 | Lindy | |
| D377,116 | S | 1/1997 | Shimura et al. | |

(Continued)

FOREIGN PATENT DOCUMENTS

| | | |
|---|---|---|
| EP | 066292 | 7/1995 |

(Continued)

*Primary Examiner*—Nathan J. Newhouse
*Assistant Examiner*—Jack Morgan
(74) *Attorney, Agent, or Firm*—Marjama Muldoon Blasiak & Sullivan, LLP

(57) ABSTRACT

A lightweight child carrier that can be mounted upon the front or the back of a wearer's torso with little or no need to adjust the carrier's harness. The carrier includes a main panel having generally a rectangular shape. The bottom edge of the main panel is joined to the top edge of a padded waist band and the bottom edge of a head restraining panel is joined to the top edge of the main panel. Shoulder straps are connected to the main panel and are cojoined by a chest strap that is slidably mounted upon each shoulder strap. Adjustable restraining straps are connected to the chest strap and to the head restraining panel. An auxiliary waist belt is provided that considerably expands the length of the waist band to allow the carrier to be worn by a woman during pregnancy.

8 Claims, 6 Drawing Sheets

U.S. PATENT DOCUMENTS

| | | | | |
|---|---|---|---|---|
| D385,105 | S | 10/1997 | Fair | |
| 5,678,739 | A | 10/1997 | Darling et al. | |
| D395,161 | S | 6/1998 | Fair et al. | |
| 5,791,535 | A | 8/1998 | Roan et al. | |
| D397,867 | S | 9/1998 | Fair et al. | |
| 5,848,741 | A | 12/1998 | Fair | |
| 5,934,528 | A | 8/1999 | Higuchi | |
| D414,032 | S | 9/1999 | Howell | |
| D453,066 | S | 1/2002 | Norman | |
| D455,546 | S | 4/2002 | Norman | |
| 6,409,060 | B2 * | 6/2002 | Donine | 224/160 |
| 6,415,969 | B1 | 7/2002 | Higuchi | |
| 6,443,339 | B1 | 9/2002 | Higuchi | |
| 6,772,925 | B2 * | 8/2004 | O'Hare | 224/155 |
| 2003/0106916 | A1 * | 6/2003 | Boone | 224/161 |
| 2004/0149790 | A1 * | 8/2004 | Kassai et al. | 224/160 |

FOREIGN PATENT DOCUMENTS

| | | |
|---|---|---|
| FR | 2806279 | 9/2001 |
| WO | WO 200189978 A1 * | 11/2001 |

* cited by examiner

BABY CARRIER

CROSS-REFERENCE TO RELATED APPLICATIONS

This application claims priority to and the benefit of U.S. provisional patent application Ser. No. 60/501,396, filed Sep. 10, 2003, which is hereby incorporated by reference in its entirety.

BACKGROUND OF THE INVENTION

This invention relates to a lightweight child carrier that can be worn by an adult with the child being positioned either in front of the wearer or behind the wearer.

There are currently any number of wearable child carriers on the market which afford the wearer freedom of hand and arm movement while transporting a child that is secured in the carrier. In pursuit of child safety, some of these devices have become overly complex involving, among other things, rigid seats and frames which considerably increase the weight of the carrier and cannot accommodate for the growth of the child. These complex carriers also are relatively heavy and place an undue strain upon the wearer, particularly in the lumbar region. In addition, because of the size of many of the present day carriers, they can only be worn on the back thus denying the child the comfort and security of a front carrier position where a child and its mother are in a face-to-face relationship. On the other hand, many simple carriers can be so poorly constructed that they can pose a danger to the wearer and the child being transported.

Most child carriers are worn by mothers who wish to be close to their young children as they go about their daily schedules. It is not uncommon for many of these women to become pregnant with a second child while the first child is still an infant. Most carriers cannot accommodate for changes in the mother's body as she goes through pregnancy and as a consequence, the carrier is rendered unusable by the mother for long periods of time.

SUMMARY OF THE INVENTION

It is therefore an object of the present invention to improve child carriers that are worn by adults.

It is a further object of the invention to provide a lightweight child carrier that is both strong and comfortable for both the child and the wearer of the carrier.

A still further object of the present invention is to provide a lightweight child carrier that can be worn on the front or the back of the wearer without the need for significant changes or modifications of the carrier's configuration.

Another object of the present invention is to provide a lightweight child carrier that can be worn in comfort by a woman while pregnant with a second child during the course of her pregnancy.

Yet another object of the present invention is to provide a child carrier that is lightweight yet safe for a child that is seated in the carrier.

These and other objects of the present invention are attained by a child carrier that is worn by an adult to transport a child in a hands and arms free manner. The carrier includes a generally rectangular-shaped main panel. The bottom edge of the main panel is joined to the top edge of a padded waist band, and the bottom edge of a rectangular head restraining panel is joined to the top edge of the main panel. A pair of shoulder straps are secured to the main panel with each forming a loop along the side edges of the panel. A chest strap is slidably retained upon each of the shoulder straps, so that the chest strap can be adjusted along the length of the shoulder straps. A pair of restraining straps are secured at one end to the upper corners of the head restraining panel and the opposite end of each restraining strap is adjustably connected to the chest strap. The waist band includes a buckle having a female member and a male member that is removable retained within the female member. An auxiliary strap is also provided that contains a male member located at one end of the strap that mates with the female member of the waist band and a female member at the opposite end of the strap that similarly mates with the male member of the waist band to considerably expand the waist band.

BRIEF DESCRIPTION OF THE DRAWINGS

For a better understanding of these and other objects of the invention, reference will be made to the following detailed description of the invention which is to be read in association with the accompanying drawings, wherein.

DESCRIPTION OF THE INVENTION

Figure 1:
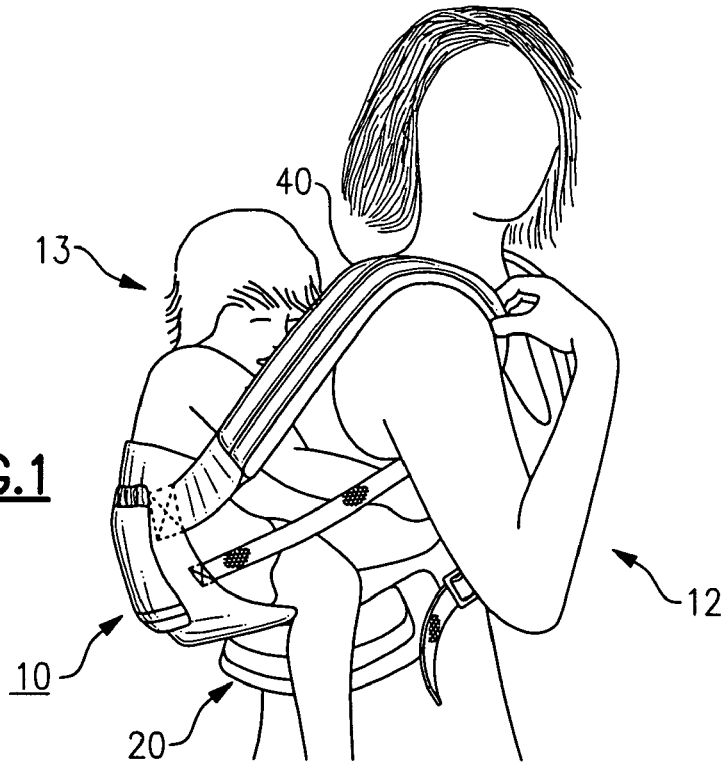
FIG. 1 is a perspective view illustrating the carrier embodying the teachings of the invention being mounted upon the back of a wearer with a child seated in the carrier.
Figure 2:
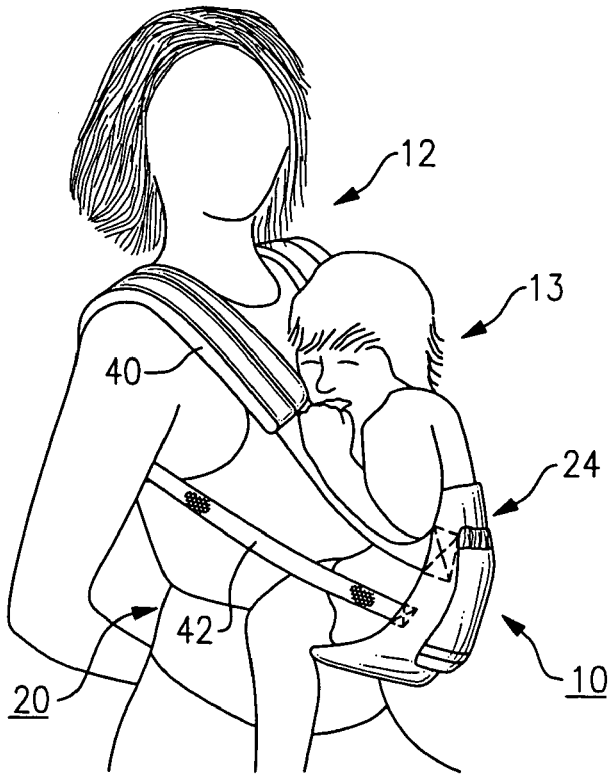
FIG. 2 is a perspective view illustrating the carrier mounted in front of the wearer with a child seated in the carrier.

Turning initially to FIGS. 1 and 2, there is illustrated two modes of mounting a child carrier, generally referenced 10, upon the torso of an adult 12. The carrier shown in FIG. 1 is mounted upon the wearer so that a child 13 that is seated in the carrier is located behind the wearer in a forward facing position facing with regard to the wearer. As will become apparent from the disclosure below, the mode of carry can be easily and simply accomplished by reversing the location of the shoulder straps upon the wearer's torso. This second mode of carry is illustrated in FIG. 2, wherein the child seated in the carrier is located in front of the wearer in face to face contiguous relation with the wearer.

The present carrier, unlike some of the more complex devices, is not only simple in construction and lightweight, but can be reversed in the mode of carry from front to back or vice versa without any major readjustment of the harness. In fact, the reversal of position can be easily and safely made while a child is seated in the body pouch of the carrier. The carrier has no rigid structures such as plastic seats or metal frames that might impede the reversal operation.

Figure 3:
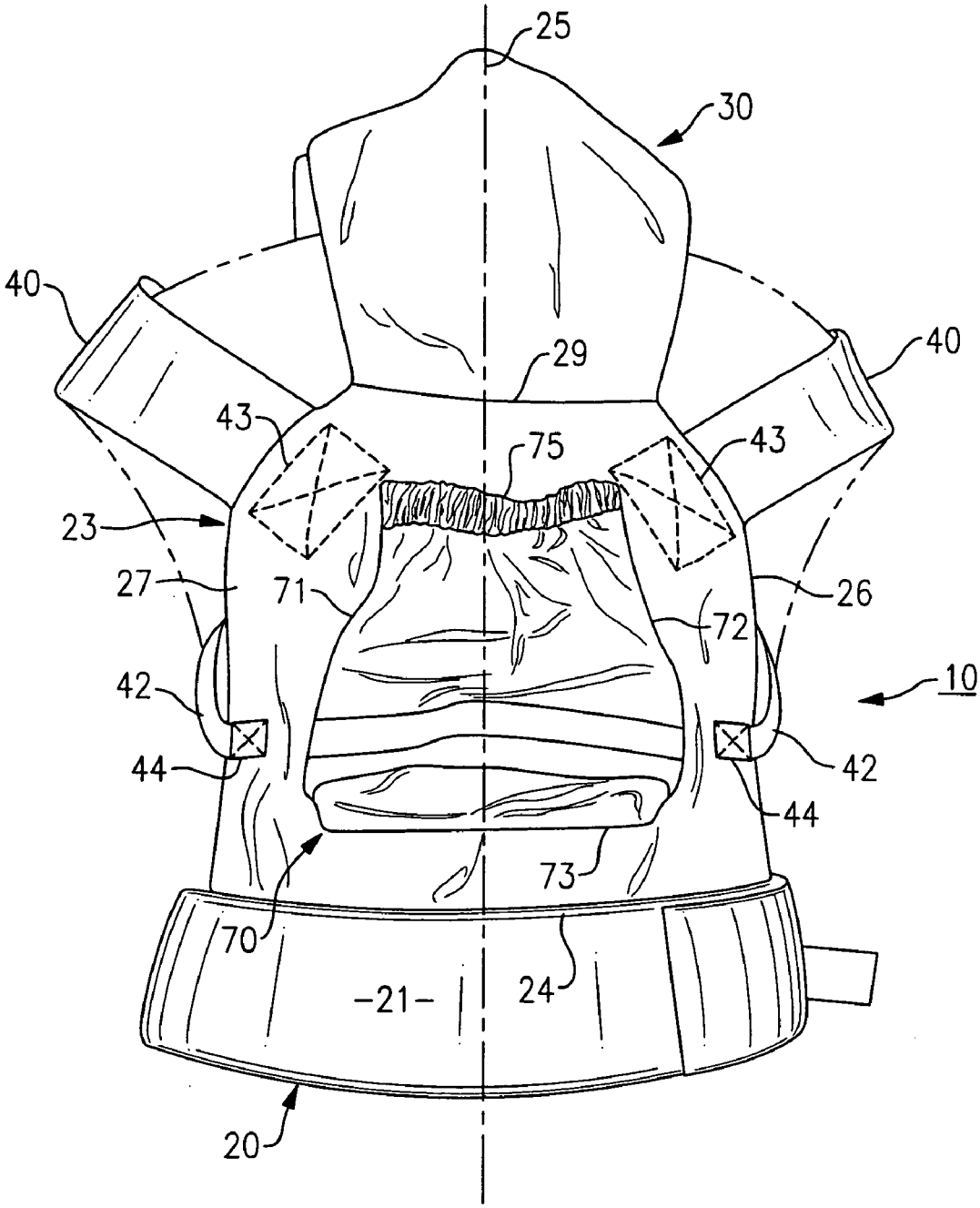
FIG. 3 is an enlarged front view of the carrier.
Figure 4:
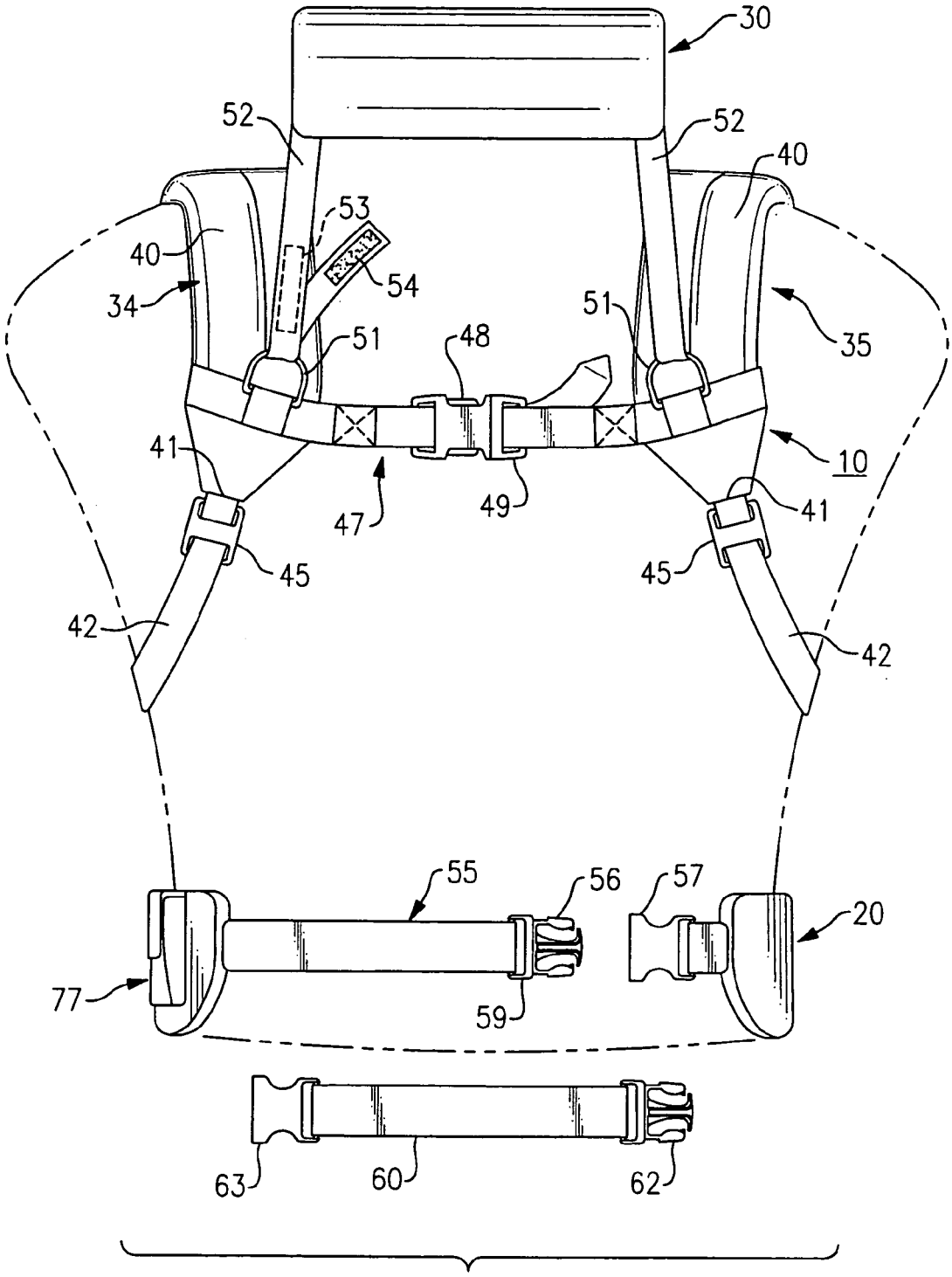
FIG. 4 is an enlarged rear view of the carrier.
Figure 5:
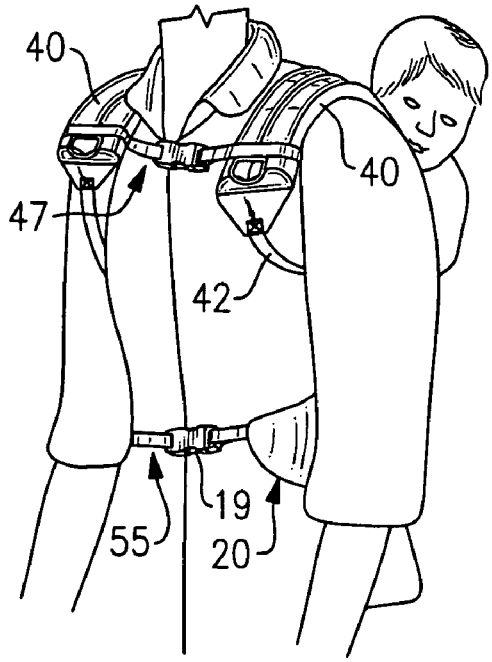
FIG. 5 is a front perspective view showing the chest strap and shoulder strap arrangements when a child is seated in the carrier mounted upon the back of the wearer.
Figure 6:
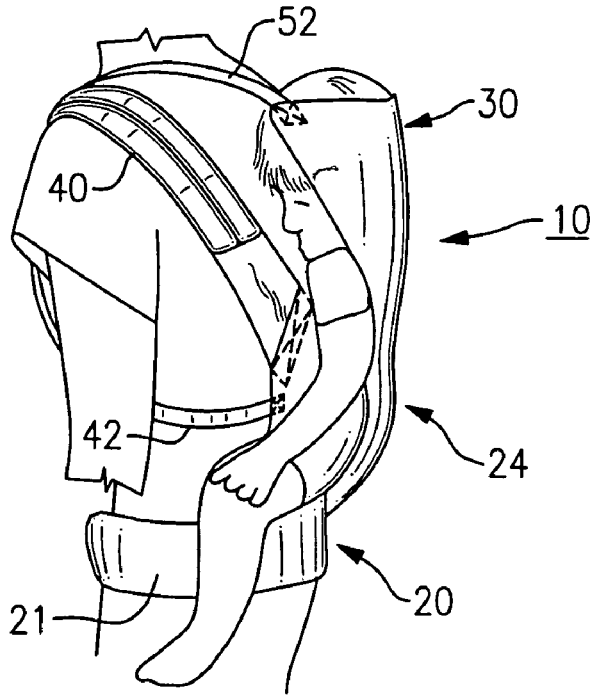
FIG. 6 is a rear perspective view showing a child seated in the carrier mounted on the back of a wearer and further illustrating the child's head being supported in the head restraint of the carrier.

Turning now to FIGS. 3 and 4, the carrier includes a waist band 20 having a wide padded section 21 that encircles the hips of the wearer when the carrier is in either a front or a rear carry position. The waist band 20 is designed to take a good deal of strain away from the wearer's lumbar region, particularly when the carrier is worn in a front carry position. The two ends of the padded section are joined by a strap 55 containing a releasable buckle 19 as best shown in FIG. 5. The carrier further includes a main panel 23 that is somewhat rectangular-shaped and is fabricated from a high strength, yet flaccid, material that can easily conform to the contour of a child's body when seated in the device. Canvas and many nylon and other high strength synthetic fabrics may be used for this purpose.

The main panel includes a bottom edge 24 that is stitched securely into the top section of the waist band 20 so that band 20 and the main panel 23 share a common vertical axis 25 of the carrier. As will be appreciated from the following description of a preferred embodiment of the invention, the baby carrier essentially possesses bi-lateral symmetry about the vertical axis 25. The main panel 23 further includes two opposed side edges 26 and 27 along with a top edge 29. The main panel 23, when sewn into the waist band 20, provides a good deal of material over the band 20 so that a generous sling is formed in which a child can be comfortably and safely seated. The sling provides ample support for the child's buttocks as well as for the back of the child's legs.

A rectangular-shaped head restraining panel 30 is sewn into the top edge 29 of the main panel 23. The head restraining panel 30 shares the common vertical axis 25 with the main panel 24 and can be fabricated from the same material as the main panel, although other lightweight, high strength materials may be used. The head restraining panel 30 thus forms a continuation of the main panel 23 so that the panels 23, 30 will cover the entire length of the head and torso of a child that is seated in the carrier. The restraining panel 30 may help support the child's head while the child is sleeping and also may be used to screen or shelter the child's head from sun, rain, or snow.

A pair of shoulder straps 34 and 35, are connected to each side of the main panel 23. Each shoulder strap 34, 35 includes a padded section 40 that is attached at one end 41 to a belt section 42. The other end of each padded section is securely sewn 43 into the main panel 23 at the two upper corners of the panel. The belt section 42 of each shoulder strap 34, 35 is looped around and is sewn into the main panel 23 at 44 below the padded end of the associated shoulder strap. Adjusting buckles 45 are operatively connected to each belt section 42 by which the length of the shoulder straps 34, 35 can be altered.

As best seen in FIG. 4, a chest strap 47 is looped at each end around each of the shoulder straps 34, 35 so that the chest strap 47 can slide up or down along the length of the shoulder straps 34, 35. The chest strap contains an adjustable buckle 48 that permits the chest strap to be opened to facilitate entering and exiting the carrier harness. One end of the buckle 48 contains an adjustable coupling 49 by which the length of the chest strap 47 can be adjusted to pull the shoulder straps 34, 35 inwardly to best suit the wearer's torso. As can be seen, the chest strap 47 can be adjusted both vertically and horizontally to attain for the wearer the most comfortable position for the harness. An adjusting buckle 45 is also mounted upon the belt section 42 of each shoulder strap 34, 35 to provide for further adjustment of the shoulder straps. The chest strap 47 of the harness contains a pair of spaced apart rings 51-51 located on either side of the buckle 48. Restraining straps 52-52 are joined to the upper two corners of the head restraining panel 30 and are looped through each of the rings 51 as illustrated in FIG. 4. A Velcro fastener is sewn into the free end of each restraining strap 52 that includes a hook pad 53 and a loop pad 54 that are aligned in series along the back of each strap 52. Instead of a Velcro fastener, the straps 52 may include a series of snap fit connectors secured to bias tape, whereby the effective length of each strap 52 may be adjusted. Each pad has sufficient length so that the head restraining panel 30 can be snuggly positioned around the child's head when the child is seated in the carrier.

The padded section 21 of the waist band 20 is joined at each end by a belt section 55 containing a bayonet type buckle having a male member 56 and a female member 57 that can be mated to releasably join the two ends of the belt 55 together. Limited adjustment of the belt length is provided by an adjusting loop 59 that forms a part of one of the buckle members. An auxiliary belt 60 is provided with the carrier which has a male member 62 at one end and a female member 63 at the other end of the belt. The male member 62 of the auxiliary belt can be mated with the female member 57 of the waist band, while the female member 63 can be mated with the male member 56 of the waist band, thus providing the waist band with considerably greater length. This feature permits a pregnant woman to use the carrier longer into her pregnancy when compared to other carriers. The waist band 20 is normally adjustable to a length of between twenty-seven to forty-five inches, and the auxiliary belt 60 effectively extends the length of waist band 20 preferably by another eight inches.

A pouch 70 with one or more pocket sections is mounted on the back of the main panel 23. The two side edges 71 and 72, as well as the bottom edge 73, of the pouch 70 are sewn into the main panel 23 while the top edge 75 remains open. An elastic band is sewn into the top edge of the pouch 70 which restricts the size of the opening to more securely retain articles stored in the pouch 70 preferably soft items, such as diapers, hats, wipes, and extra clothing. The pouch 70 is centered upon the vertical axis 25 of the carrier below the head restraining panel 30. Accordingly, the head restraining panel 30 can be conveniently stored within the pouch 70 when not in use.

A second, smaller pouch 77 with one or more pocket sections is sewn into the waist band 20 in which such items as currency, credit cards, sunglasses, a cell phone, writing implements, a wallet, a checkbook, and keys can be stored. The second pouch 77 may be selectively opened and closed with snap fit connectors, a zipper, hook and loop fasteners, buttons, or other mechanisms.

Figure 7:
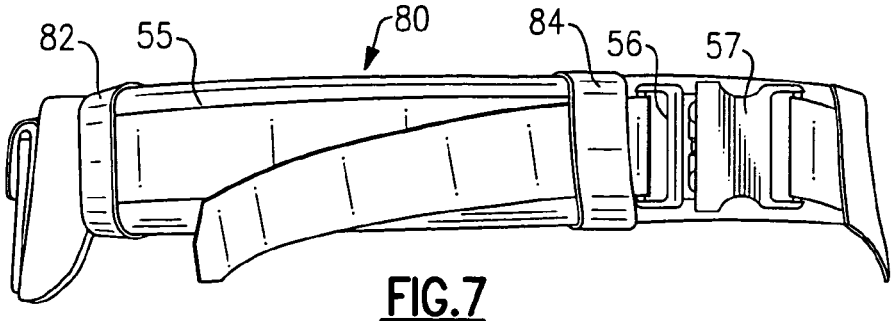
FIG. 7 is a plan view of a belly pad that may be utilized with the carrier shown in FIGS. 1-6.

The carrier may also include a belly pad 80 as shown in FIG. 7. The pad 80 preferably possesses a generally flat, rectangular configuration and an exterior sheath fashioned of the same fabric as the carrier and contains an interior foam or other resilient material substantially throughout its width and length. The belly pad 80 preferably includes a pair of longitudinally spaced, elastic bands 82, 84 extending laterally across, and sewn or otherwise secured to, the exterior fabric. Each band 82, 84 forms a shallow opening or loop with the adjacent fabric such that the male member 56 of the buckle on the belt section 55 may snugly pass therethrough. It will be appreciated that the belly pad is preferably positioned between the belt section 55 (and its associated bayonet type buckle having a male member 56 and a female member 57) and the stomach or abdomen of the wearer. As such, the belly pad 80 provides better dispersion of the forces acting upon the belt section 55 and more comfort to the wearer. When the belly pad 80 is so positioned, the longitudinal ends of the belly pad 80 are situated in a layer between the corresponding ends of the waist band 20 and the wearer. It should also be appreciated that one of the bands 84 is preferably disposed adjacent to the adjustment portion of the male member 56 when the members 56, 57 are connected so that if the male member 56 and the female member 57 become inadvertently disconnected, the band 84 will inhibit the members 56, 57 from being further separated. Thus, the band 84 enhances the safety of the carrier.

Figure 8:
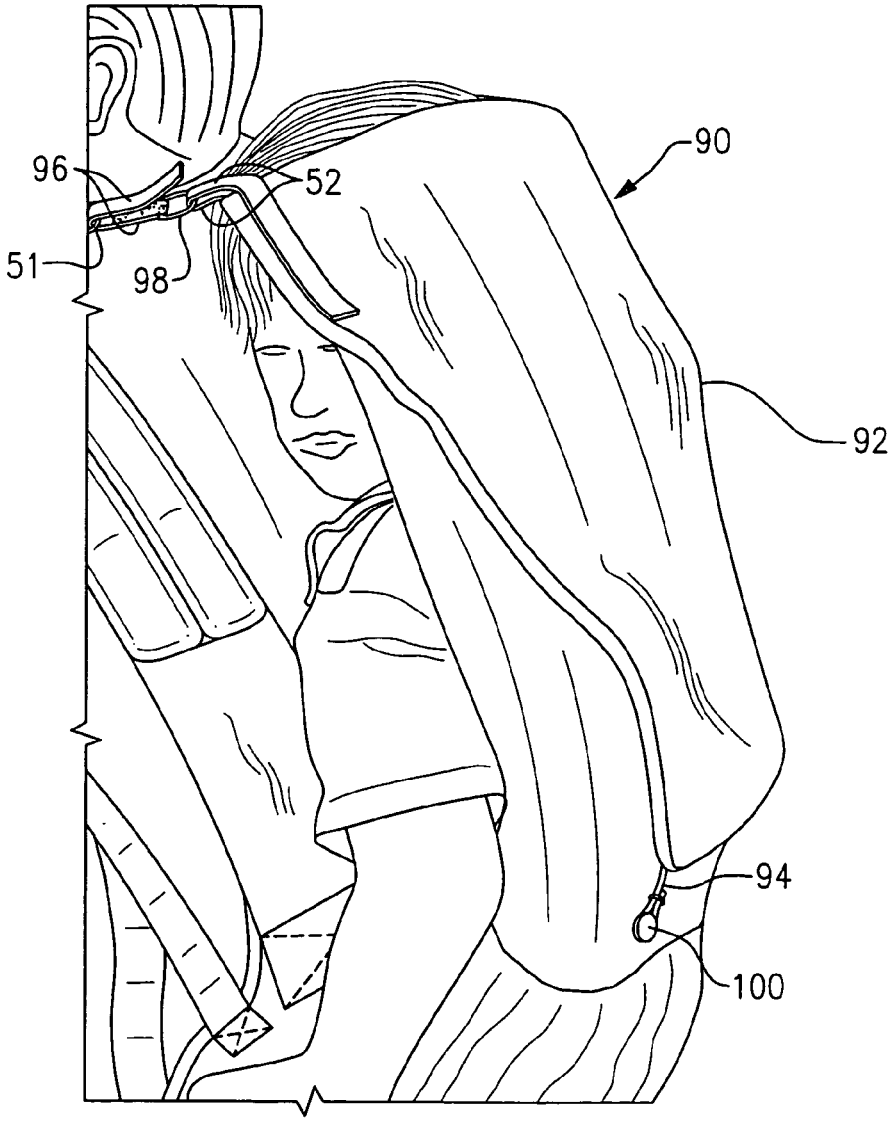
FIG. 8 is a perspective view of a hood extension that may be utilized with the carrier shown in FIGS. 1-6.
Figure 9:
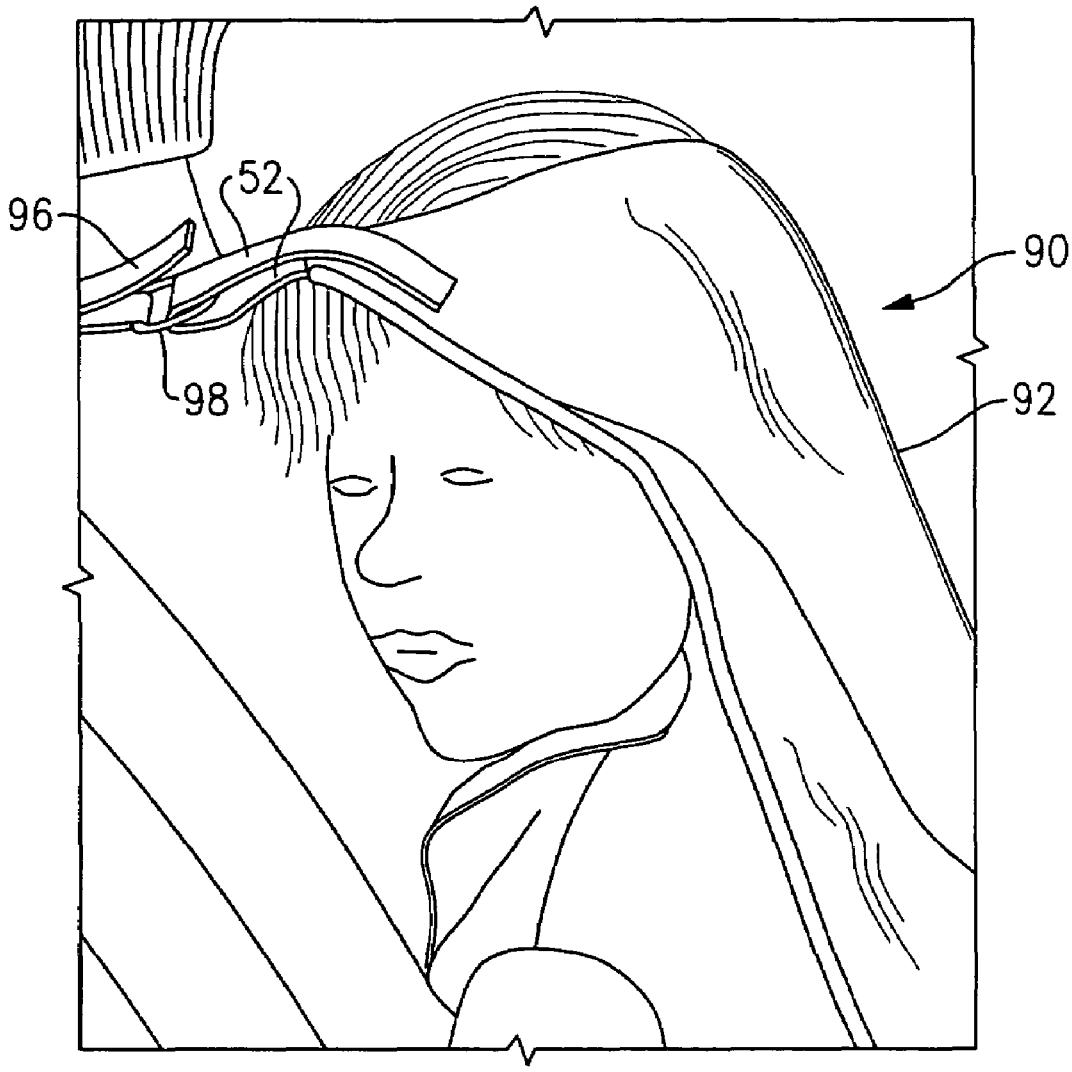
FIG. 9 is a different perspective view of the hood extension shown in FIG. 8.

The carrier may further include a hood extension 90, shown in FIGS. 8 and 9, for cradling and restraining the head of a relatively large child whose head extends beyond the head restraining panel 30. The hood extension 90 includes a sheet 92 preferably fashioned of the same fabric as the head restraining panel 30 and possessing the configuration of an isosceles triangle. A looped string or cord 94 is attached to the apex of sheet 92. The hood extension 90 may also include a pair of strap extensions 96 having a D-ring 98 secured to one end thereof and an affixed hook pad adapted to cooperate with an affixed loop pad as components of a Velcro fastener. The inner and outer surfaces along each lateral edge near the base edge of the triangular sheet 92 also possess a hook pad and a loop pad component of a Velcro fastener.

The hood extension 90 is assembled onto the carrier preferably as follows. The free end of each restraining strap 52 is inserted through the D-ring 98 of an associated strap extension 96, and then the free end of each strap extension 96 is inserted through an associated ring 51 on the chest strap 47. Each strap extension 96 is then folded back upon itself so that the hook pad and the loop pad selectively, cooperatively fasten together whereby each strap extension 96 loops through an associated ring 51. Each lateral edge near the triangular base of the sheet 92 is then placed against the hook or loop pad of an associated restraining strap 52 and the free end of each restraining strap 52 is placed over the associated lateral edge such that the hook and loop pads of the restraining strap 52 selectively, cooperatively fasten to the hook and loop pads affixed to the lateral edges of the sheet 92. Thus, each lateral edge is sandwiched between the overlapping segments of an associated restraining strap 52, as best shown in FIG. 9. A button 100 may then be sewn or secured to the carrier where the looped cord 94 overlaps the carrier, and the button 100 may then be selectively inserted through the looped cord 94 to secure the apex of the sheet 92 against the carrier such that the sheet 92 substantially abuttingly overlays the carrier, as best shown in FIG. 8.

The baby carrier also may be used to carry infants by tucking or wrapping the infant in a blanket or quilt and placing the infant in the main panel 23 with the infant's legs together on one side, the head leaning to the other side, and the butt centered in the middle of the main panel 23. In such a carrying mode, the carrier acts more like a sling.

It will be appreciated that the child is secured in the baby carrier in a seated position, with most of the child's weight being dispersed through the hips and thighs, thereby substantially eliminating compression of the spine (and potentially hip dysphasia) that occurs when a child is hanging in the carrier by the crotch. When the child is seated in the child carrier, at least about seventy percent to ninety percent of the child's weight is transmitted directly through the waist band 20 to the wearer's hips, and not through the wearer's shoulders or upper spine, thereby promoting wearer comfort and diminishing wearer fatigue. The baby carrier also positions the child when the child is in front of the wearer so that the head and mouth of the child are conveniently aligned for nursing.

Preferably, the carrier is fashioned of a fabric material such as cotton canvas for exterior facing surfaces and brushed cotton twill for interior facing surfaces. Preferably the carrier is substantially deformable and machine washable and dryable and weighs less than about two or three pounds.

While this invention has been particularly shown and described with reference to the preferred embodiment in the drawings, it will be understood by one skilled in the art that various changes in its details may be effected therein without departing from the teachings of the invention.

What is claimed is:

1. A carrier for a child that includes:

a main panel possessing a top edge, a bottom edge, and two opposed side edges;

a waist band adapted to encircle the waist of a wearer, said waist band having a top edge that is joined to the bottom edge of the main panel so that the main panel is substantially centered upon the waist band;

first and second shoulder straps, each shoulder strap being attached at an upper end to an upper corner of the main panel and at the lower end to the main panel below the upper end of the shoulder strap so that each shoulder strap forms a loop;

a chest strap slideably secured at each end to one of said shoulder straps;

a head restraining panel possessing a top edge, a bottom edge, and two opposed side edges, the bottom edge of the head restraining panel being joined to the top edge of the main panel so that the head restraint panel is substantially centered upon the main panel;

restraining straps secured to each upper corner of the head restraining panel, said restraining straps being secured to said chest strap by detachable connectors;

said waist band containing a buckle having a female member and a male member that is removably retained in the female member; and an auxiliary strap having a female member mounted upon one end thereof that is connectable to the male member of said waist band and a male member mounted upon the other end thereof that is connectable to the female member of the waist band.

2. The carrier of claim 1, wherein said chest strap contains a releasable buckle mounted upon the chest strap and a retaining ring mounted on the chest strap on either side of said buckle.

3. The carrier of claim 2, wherein the detachable connector on each of said restraining straps includes a hook pad and a loop pad mounted in series upon one side of the strap whereby the strap can be looped through a retaining ring of the chest strap and the hook pad secured to the loop pad.

4. The carrier of claim 3, wherein said chest strap further includes an adjusting means for adjusting the length of the chest strap whereby the chest strap can be slideably brought to a desired position along the shoulder strap and then tightened to secure the chest strap in said desired position.

5. The carrier of claim 1 that further includes a storage pouch mounted upon the outside of the main panel in which the head restraining panel can be stored when not in use.

6. The carrier of claim 5 wherein said storage pouch is substantially centered upon the main panel.

7. The carrier of claim 5 that further includes a second storage pouch mounted upon the waist band.

8. The carrier of claim 1 wherein the waist band contains a heavily padded section for encompassing the lumbar region of the wearer.

* * * * *